United States Patent [19]

Fréchin

[11] 3,930,660

[45] Jan. 6, 1976

[54] SKI BINDING

[75] Inventor: Jean-Paul Fréchin, Chamonix, France

[73] Assignee: Mitchell S.A., France

[22] Filed: Feb. 12, 1974

[21] Appl. No.: 441,759

[30] Foreign Application Priority Data

Feb. 16, 1973 France ..... 73.05594

[52] U.S. Cl. 280/11.35 K; 36/2.5 AL; 280/11.35 E

[51] Int. Cl.[2] ..... A63C 9/081

[58] Field of Search...280/11.35 K, 11.35 D, 11.35 E, 280/11.35 Y, 11.35 G, 11.35 R; 36/2.5 AL

[56] References Cited

UNITED STATES PATENTS

| | | | |
|---|---|---|---|
| 2,491,485 | 12/1949 | Durham | 280/11.35 K |
| 2,545,574 | 3/1951 | French | 280/11.35 Y |
| 3,838,866 | 10/1974 | D'Alessio | 280/11.35 K |

FOREIGN PATENTS OR APPLICATIONS

| | | | |
|---|---|---|---|
| 412,672 | 11/1966 | Switzerland | 280/11.35 K |

*Primary Examiner*—Leo Friaglia
*Assistant Examiner*—David M. Mitchell
*Attorney, Agent, or Firm*—Robert E. Burns; Emmanuel J. Lobato; Bruce L. Adams

[57] ABSTRACT

A ski binding includes a soleplate, integral with a boot sole or adapted to carry a boot, to which a plate is hinged at one end about a transverse axis, this plate having an opening with a bevelled edge which passes about and comes to jam under the head of a pin fixed perpendicular to the ski. A spring urged locking member acts on the other end of the soleplate to releasably hold said other end against pivoting about said transverse axis or about said pin, and to releasably jam said opening under the head of the pin. A fixture can be provided for locking said plate on the ski whereby, when said locking member is disengaged, the soleplate is freed for pivoting about the transverse axis e.g. during ski touring.

9 Claims, 12 Drawing Figures

SKI BINDING

This invention concerns security bindings for skis comprising a soleplate, designed to be fitted under the sole of a boot, approximately equal in length to the said sole, the soleplate being hinged at one of its ends about two pins, a first pin being at right angles to the ski, a second pin being parallel to the ski, a spring locking system being arranged opposite the other end of the soleplate and working in conjunction with one or more locations provided on the said soleplate.

In a known ski binding of this type described in French Pat. No. 841,238 the soleplate is hinged at the front about two axes by means of a cardan joint, or a ball-and-socket joint. In its normal working position, the back of this soleplate is held on the ski by a spring locking system. This type of ski binding has disadvantages because, when a skier falls, it allows only the heel of the boot to move upwards and/or sideways when the load exerted by the boot in these directions exceeds a predetermined minimum value; the front of the soleplate remains attached to the ski and cannot move upwards or sideways.

Another known ski binding described in U.S. Pat. No. 2,545,574 comprises a soleplate adapted to carry a boot, the front of this soleplate being hinged, about an axis parallel to the ski face, to a lower hinge plate. The latter plate has a longitudinal slot by means of which it, together with the soleplate, can slide and pivot relative to the ski about a vertical pin screwed in the ski surface. Springs are provided to normally urge the soleplate backwards into a position where its rear end meets up against a locking device. In the case of a fall, the soleplate moves forwards and is able to pivot once freed from the locking device. This binding also suffers the disadvantage that the front of the soleplate remains permanently connected to the ski, so that a complete freeing of the soleplate with the skier's boot from the ski is not possible, and in particular it is not possible to raise the toe end of the soleplate relative to the ski.

A further disadvantage common to the two abovementioned bindings is that no means is provided for releasing the binding in the event of a torsional effort on the ski boot about an axis parallel to the longitudinal axis of the ski.

An object of the invention is to provide a ski binding system which overcomes or avoids the mentioned drawbacks.

A particular object is to provide a type of binding in which, when the load exerted by the boot exceeds a predetermined minimum value, it is not only possible to obtain movement of the back of the soleplate supporting the said boot upwards and/or sideways but is also possible, in the instance where a skier may fall backwards, to obtain an upward movement of the front of the soleplate. A further aim is to enable the soleplate to be released by torsion about an axis substantially parallel to the longitudinal center line of the ski.

A subsidiary object of the invention is to provide a binding including a soleplate which can be incorporated in a boot sole, which leads to simplification and economy and also enables the extra thickness of a separate soleplate under the boot sole to be dispensed with.

A further subsidiary object is to enable the skier, at will, to walk with his skis easily over flat ground or uphill.

The ski binding which is the subject of the invention comprises a soleplate secured to the sole of a boot by any means. The soleplate is hinged at one of its ends about two axes, a first axes being perpendicular to the ski and consisting of a pin having an enlarged head and secured to the ski, the soleplate being hinged to an intermediate plate round a second axis parallel to the ski. This intermediate plate is held on the ski, when the binding is in the "locked for use" position, by a spring locking device, consisting of cooperating relatively inclined surfaces on the said intermediate plate and on the underside of the head of the vertical pin, and by spring operated means arranged at the other end of the soleplate and holding said inclined surface together, through the intermediary of the said soleplate, the said soleplate having at least one profile matching at least one corresponding profile on the said spring operated means.

According to one embodiment of the invention, this soleplate and the intermediate plate hinged to it, are built in to the sole of the boot, the extra thickness of the soleplate being at least partly dispensed with. At the same time, means for unlocking the soleplate at will are provided on the spring operated locking device in such a manner that a boot fitted with this type of sole can be released from the ski by the skier at will, when he wishes to remove his skis.

Lastly, according to another embodiment of the invention in which the soleplate is hinged at the front end of the soleplate, the locking device at the rear comprises a means for holding said device in an unlocked position, the binding having in addition an auxiliary means for locking the intermediate plate against rotation about the vertical pin and axially to the ski in such a position that the inclined surface on the intermediate plate is constantly held towards the front, locked under the head of the pin. These auxiliary means are used, after unlocking the rear spring locking device, for walking with the skis on, the rear end of the soleplate being able to rise freely.

Said auxiliary means for locking the intermediate plate about and axially to the ski may consist of a hook whose position can be adjusted by hand along the center line of the ski, located in front of the soleplate, the said hook being adapted to at least indirectly engage with a part of the intermediate plate, and control means for holding the hook downwards and/or forwards under pressure to hold said intermediate plate.

The invention also concerns a ski boot the sole of which incorporates a soleplate and hinged intermediate plate forming part of the overall binding system.

The accompanying drawings illustrate, by way of example, several embodiments of ski bindings according to this invention. In the drawings.

Figure 1:
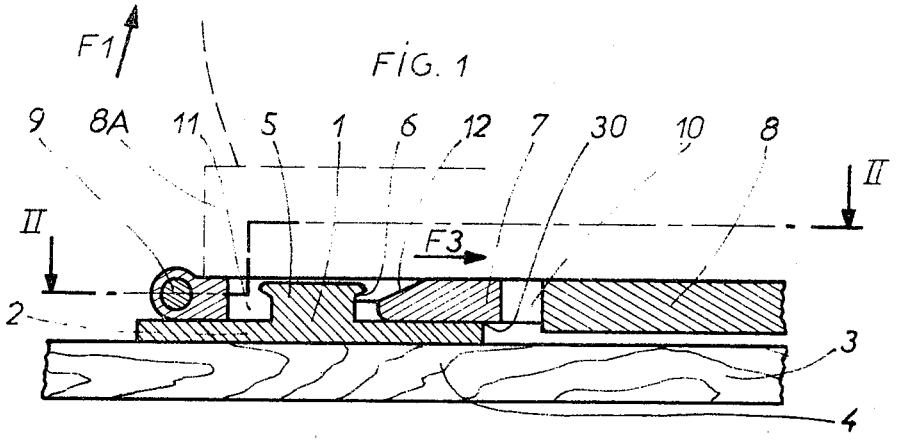
FIG. 1 illustrates one of the ends, front or rear, a first embodiment of ski binding according to the invention, seen in cross-section.
Figure 2:
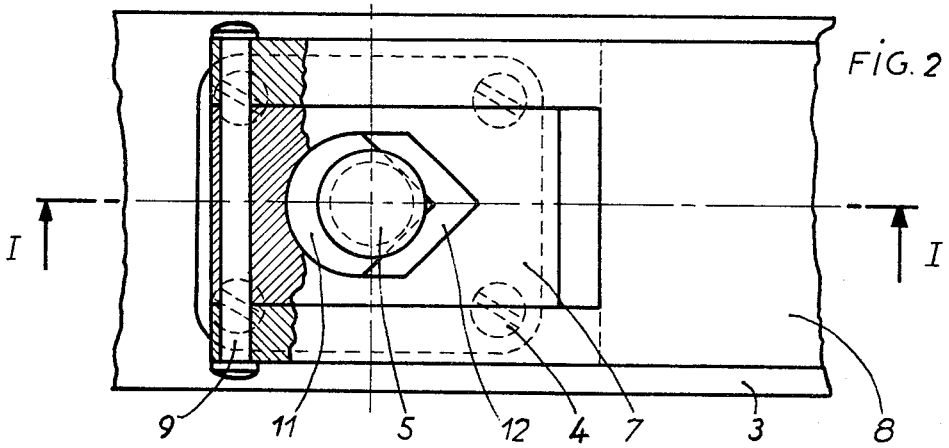
FIG. 2 illustrates the same end in plan view from above.
Figure 3:
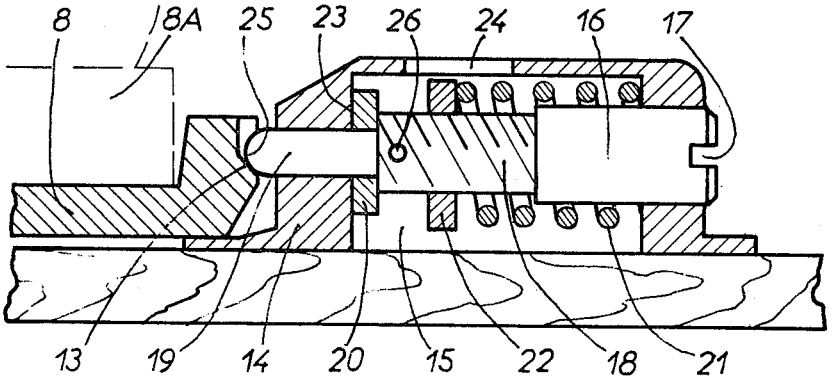
FIG. 3 illustrates the other end, rear or front as the case may be, of the first embodiment, seen in cross-section.

As illustrated in FIGS. 1 to 3, the ski binding has a first pin 1 at one of its ends, integral with a base 2 secured to a ski 3 by screws 4. The pin 1 has a flange or head 5 with a downwardly directed inclined face 6. Moreover, the binding includes an intermediate plate 7 hinged to a soleplate 8 by a shaft 9. Shaft 9 may be made differently, for example in two sections along the same center line, without being outside the scope of the invention.

A boot 8A is fixed to the soleplate 8 by any known means. The intermediate plate 7 itself has an opening 11 having, at its right hand end, looking at the drawings, an inclined surface, Vee-shaped for example, arranged symmetrically in relation to the longitudinal center line of the binding. When the binding is in the "locked for use" position, as illustrated in FIG. 2, the inclined surface 12 is in contact with face 6 on the underside of head 5 on pin 1. In this position, shaft 9 is parallel to the top face of the ski and at right angles to the ski's longitudinal center line or axis.

At the other end of the soleplate 8, as illustrated in FIG. 3, a central recess 13 is provided. A spring locking device is arranged along the ski's center line to cooperate with recess 13 in soleplate 8. This known locking device contrived in any manner comprises, for example, a hollow housing 14 fixed to the ski, and having an inner cavity 15. A spindle 16, machined with a slotted head 17, having a threaded portion 18 along its center section and a smooth cylindrical end section 19 pointing towards the soleplate, is mounted in cavity 15. This spindle 16 is guided at each of its ends in bores of housing 14 of suitable diameter. A washer 20 is placed on the end of the cylindrical section 19 to act as a stop, and it butts against the end of the threaded portion 18. A spring 21 exerts pressure continuously on a nut 22 fitted on the threaded portion 18, washer 20 thus being continually pressed against face 23 on the housing. A pin 26 fixed to spindle 16 limits movement of nut 22. A graduated window 24 is provided in the top part of housing 14, thus enabling the degree of compression of spring 21 to be observed according to the position of nut 22 in relation to window 24. When the binding is in the "locked for use" position, as illustrated in FIG. 3, the rounded end 25 of cylindrical portion 19 engages in recess 13 on soleplate 8. It will be noted that recess 13 on the soleplate could be formed by a raised or convex profile, the cylindrical portion 19 having a corresponding recessed or concave profile.

According to a first construction of this first embodiment, FIGS. 1 and 2 illustrate the front of the binding and FIG. 3 illustrates the rear.

Operation of this first construction is as follows: In the event of the skier falling forwards, the rear part of boot 8A, FIG. 3, tends to raise the rear part of soleplate 8, to which it is fixed. As soon as the load exerted by the boot exceeds a predetermined value corresponding to a given compression of spring 21, the rear of the soleplate 8 moves upwards, its recess 13 pushing back the spherical end 25 of the cylindrical portion 19 against the action of spring 21. Soleplate 8 is thus released and is able to move upwards hinging about shaft 9, FIG. 1, the soleplate being able to separate itself completely from the ski, head 5 passing through aperture 11, and soleplate 8 remaining fixed to the sole of the boot.

In the event of the skier falling backwards, the front part of the boot tends to raise the front part of the soleplate 8, to which it is fixed. As soon as the load exerted by the boot exceeds a predetermined minimum value, the front of soleplate 8 moves upwards in the direction of F1, the intermediate plate 7 taking the load at 30 on base 2. At the same time, the inclined surface 12 on the intermediate plate is pushed back in the direction of F3 by face 6 under head 5 on pin 1 and soleplate 8 itself moves in the direction of F3, pushing back the cylindrical portion 19 against the action of spring 21 until the soleplate 8 separates itself completely from the ski by head 5 passing through aperture 11.

In the event of a fall tending to twist the boot about an axis generally perpendicular to the ski, it is the rear part of the soleplate 8 which releases laterally from the rear spring locking system, the said soleplate 8 pivoting round the vertical pin 1 and being able to separate itself completely from the ski, as in the previous instance.

In the event of a sideways fall tending to twist the boot about an axis generally parallel to the longitudinal axis of the ski, the soleplate 8 release in a similar manner to the case of twisting described above.

In the event of the skier falling fowards, with a simultaneous twist of the boot, it is the rear part of the soleplate 8 which releases obliquely from the rear spring locking device, the said soleplate pivoting at one and the same time round the vertical pin 1 and the horizontal shaft 9.

In the event of the skier falling backwards with a simultaneous twist of the boot, the rear part of the soleplate 8 releases laterally from the rear spring locking device by turning round the vertical pin 1; at the same time the soleplate 8 moves to the rear under the action of the face 6 of pin 1, pushing back the inclined surface 12 on the intermediate plate.

According to a second construction of this first embodiment, FIG. 3 illustrates the front of the binding and FIGS. 1 and 2 illustrate the rear.

The operation of each of the ends of the binding remains unaltered. There is only a reversal of functions between the two ends; the end which, in the first construction, ensured safety when falling forwards (FIG. 3), now ensures safety when falling backwards, and vice versa.

Figure 4:
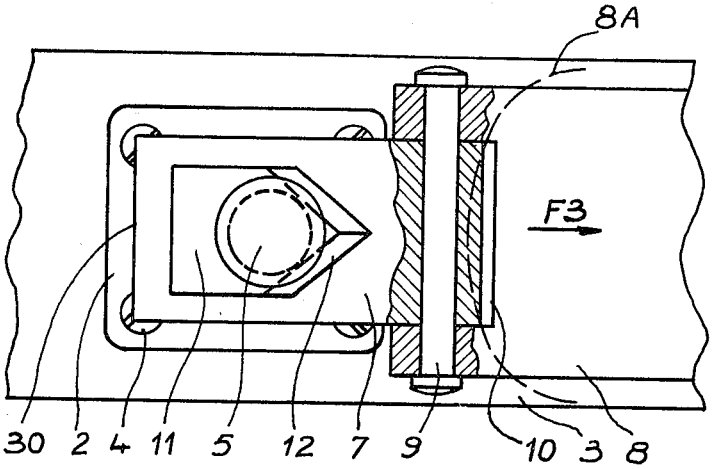
FIG. 4 illustrates one of the ends of a second embodiment of a ski binding according to this invention, in plan view from above.

FIG. 4 illustrates a second embodiment of one of the ends of a binding according to this invention. In this embodiment, intermediate plate 7, instead of being completely located in a slot 10 in soleplate 8, is arranged outside the said plate in such a way that it is not covered by the sole of boot 8A when the sole is fixed to the soleplate. All the other characteristics are identical to those in the first embodiment.

Just as in the first embodiment, this device can be used for holding the front or rear of the soleplate, the spring locking device previously described holding the other end.

The operation of this second embodiment is identical to that of the first embodiment.

Figure 5:
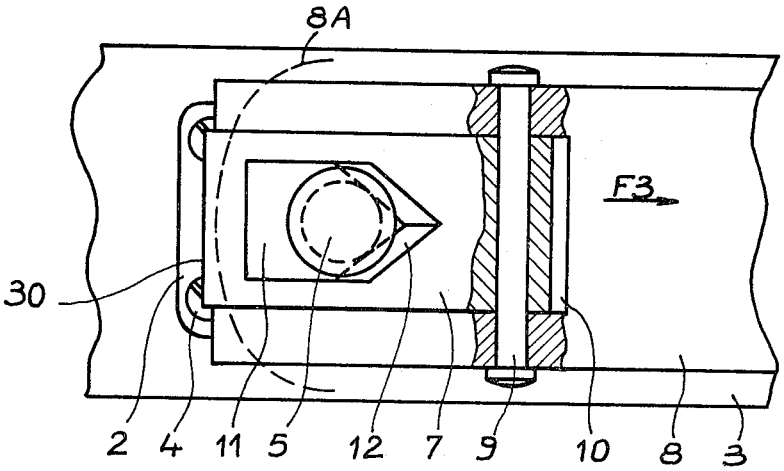
FIG. 5 illustrates one of the ends in a third embodiment of ski binding according to this invention, in plan view from above.

FIG. 5 illustrates a third embodiment of one of the ends of a binding according to this invention. In this embodiment, intermediate plate 7 is located completely in slot 10 in the soleplate, in a similar manner to the first embodiment; however its hinge shaft 9 is not placed right at the end of the soleplate but is placed as illustrated in FIG. 5. This third embodiment somewhat resembles the second embodiment; however, in this instance the sole of boot 8A covers both the soleplate 8 and intermediate plate 7. All the other characteristics are identical to those in the first embodiment. Just as in the two previous embodiments, this device can be used to hold the front or rear of the soleplate, the spring locking device previously described holding the other end. The operation of this third embodiment is identical to that for the first embodiment, except that when the binding releases by raising of the end of the soleplate held by the rounded end 25 (FIG. 3), as the soleplate hinges about shaft 9, the inclined surfaces 12 and face 6 come into play to move soleplate 8 and intermediate plate 7 in the direction of arrow F3.

Figure 6:
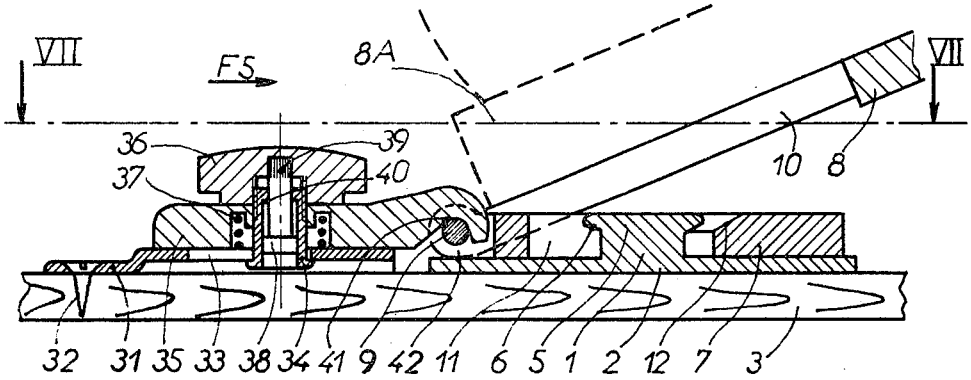
FIG. 6 illustrates a front end of a fourth embodiment of ski binding according to the invention, in cross-section.
Figure 7:
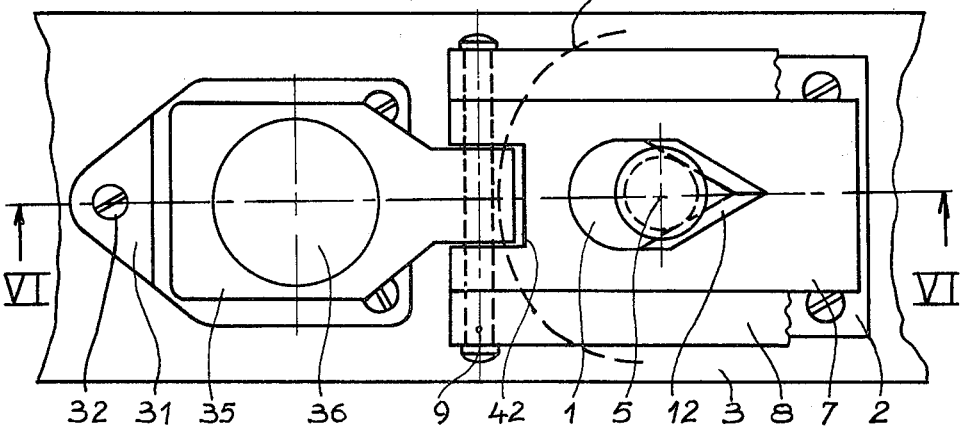
FIG. 7 is a top plan view corresponding to FIG. 6.
Figure 8:
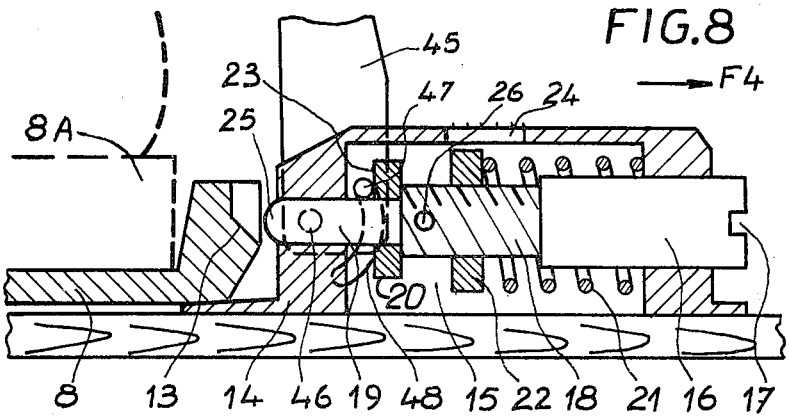
FIG. 8 illustrates the rear end of the fourth embodiment, in cross-section.

FIGS. 6 to 8 illustrate a fourth embodiment of binding according to the invention. In this embodiment, the intermediate plate must be hinged at the front end of the soleplate. FIGS. 6 to 8 reproduce all the components illustrated respectively in FIGS. 1 to 3, and the following components in addition. A plate 31, fixed to ski 3 by screws 32, is provided in front of soleplate 8 and its hinge pin 9. This plate has a rectilinear slot 33 defining a slideway along the ski's center line. A peg 34, which is able to slide in slot 33, positions a retaining component 35. A setting knob 36 enables the retaining component 35 to be moved axially in relation to the peg against the action of a spring 37. A head 38 on a pin 39 is fitted inside the peg, the end of the pin being driven into the setting knob 36. Head 38 is restricted in its movement upwards by inner face 40 in peg 34. The end of the retaining component facing towards the soleplate 8 is provided with a hook 41 able to cooperate at least indirectly with a corresponding profiled section of the intermediate plate, constituted for example by the center portion of horizontal shaft 9 fixed to the intermediate plate. A cut-out 42 in the intermediate plate enables hook 41 to rest on shaft 9.

Behind the soleplate, the spring locking device for the soleplate comprises, as illustrated in FIG. 8, means for holding the said device in an "unlocked" position, constituted for example by a lever 45 pivotally mounted on housing 14 about a horizontal pin 46. Lever 45 carries a pin 47 which is able to move in apertures 48 in housing 14 when lever 45 is rotated, the said pin 47 simultaneously moving spindle 16 through the intermediary of washer 20 acting against spring 21, the spherical end 25 of plunger 19 being thus moved in the direction of arrow F4 and held in the position illustrated in FIG. 8. All the other components previously described in the first embodiment (FIG. 3) remain unchanged.

Operation of this fourth embodiment is as follows: When the skier wishes to move across flat or rising ground, he is able to set the binding in a "walking" or "touring" position. To do this without having to remove his skis, he loosens the retaining component 35 by turning setting knob 36, moves the said component in the direction of F5 until hook 41 is in line with shaft 9 and then retightens knob 36, holding hook 41 firmly down on the corresponding profile of shaft 9. The intermediate plate 8, also soleplate 7 carrying the boot, thereby became unable to rotate about pin 1 or to make an axial movement relative to the ski. Actuation of lever 45 located at the rear of the binding enables the rear locking device to be held unlocked, the rear of the soleplate 8 thus being free to follow movements of the boot heel.

According to a variation of this embodiment, the intermediate plate 7 is arranged in front of the soleplate 8, as illustrated in FIG. 4, hook 41 then resting directly on a portion 30 of the intermediate plate.

Figure 9:
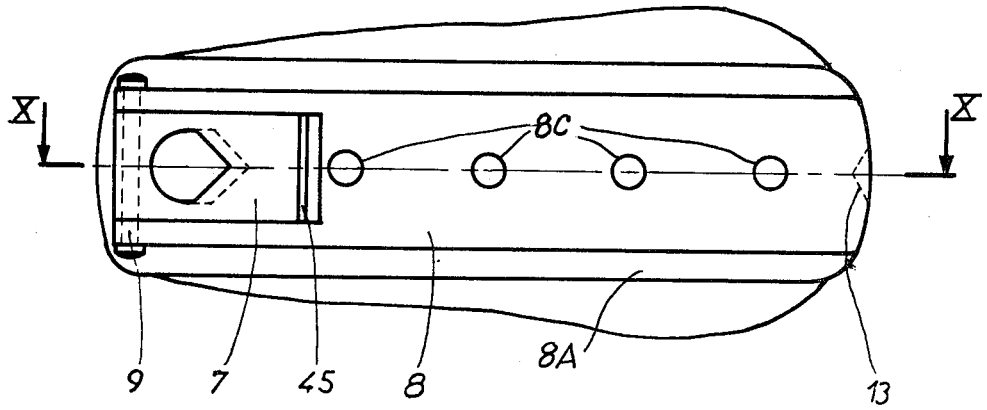
FIG. 9 is an underneath plan view of a fifth embodiment consisting of a boot in the sole of which a soleplate is incorporated.
Figure 10:
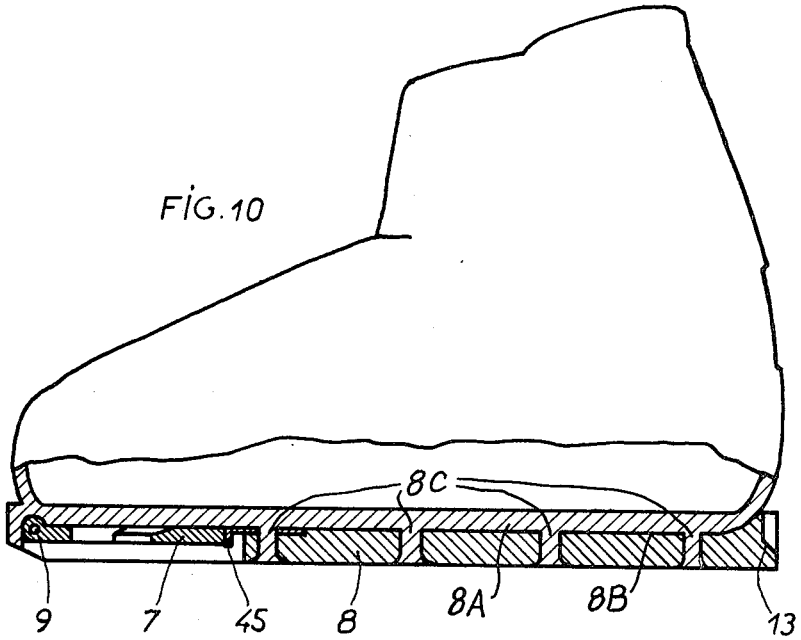
FIG. 10 is a side elevational view of the same boot partly in cross-section.

FIGS. 9 and 10 illustrate a fifth embodiment of the invention in which soleplate 8 and intermediate plate 7 hinged on it are incorporated in a boot sole 8A, the soleplate being fixed in the sole and supported by and on a lower surface portion 8B of sole 8A by rivets 8C integrally incorporated by any suitable means, by molding for example.

All the preceding embodiments employ plates 7 and 8 which are capable of being incorporated in a boot sole, with the exception of the second embodiment. FIG. 9 shows an example in which soleplate 8 and intermediate plate 7 are identical to those in the first embodiment. Spring biasing means, for example a leaf spring 45, are provided to hold intermediate plate 7 under the sole when walking without skis. To enable a boot comprising such a sole to be detached at will from the ski, either a temporary or permanent means of unlocking is necessary. It is constituted, for example, by the rear locking device previously described and illustrated in FIG. 8. The device in FIG. 8 enables permanent unlocking, however, a temporary unlocking device would be sufficient to release the boot from the ski at will.

Figure 11:
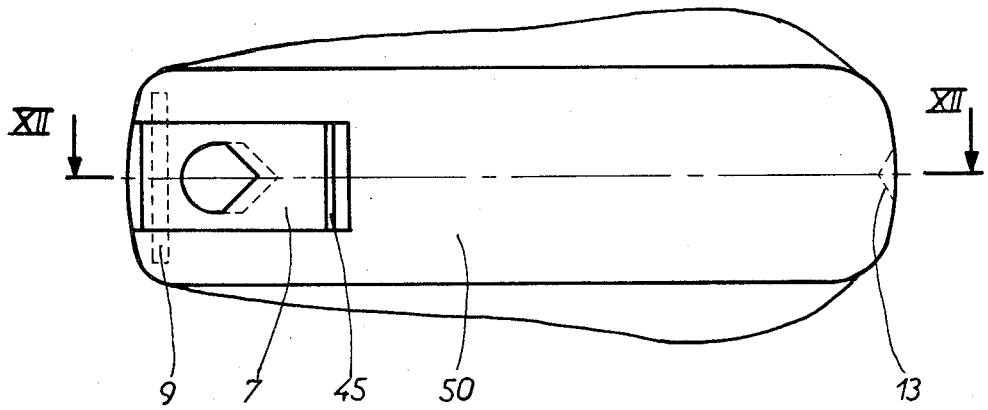
FIG. 11 is an underneath plan view of a sixth embodiment in the form of a boot whose sole conforms to this invention.
Figure 12:
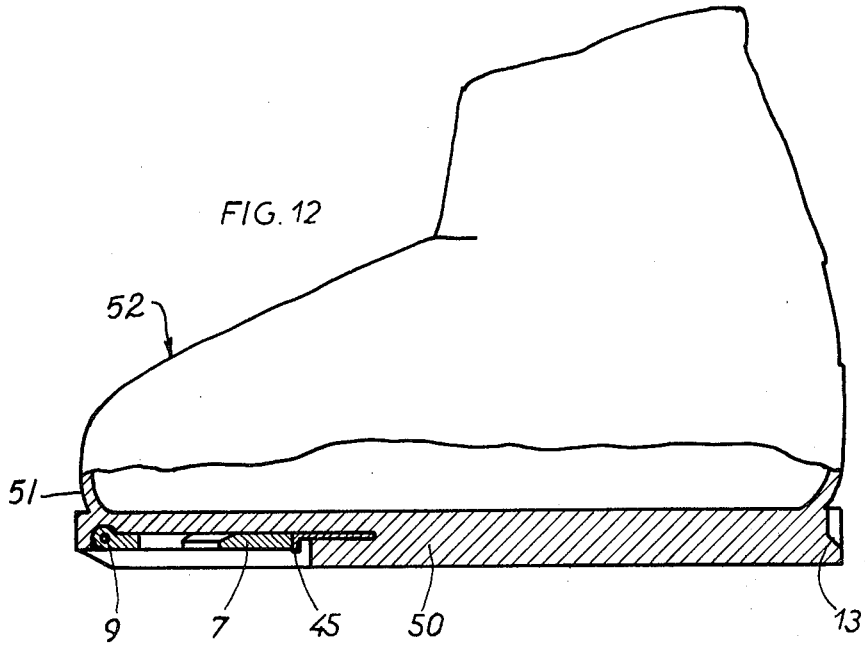
FIG. 12 illustrates the same booth in part cross-section.

FIGS. 11 and 12 illustrate a sixth embodiment of the invention in which the soleplate 50 is integrally secured to upper part 51 of boot 52. As in the fifth embodiment the front of the soleplate comprises an intermediate plate 7 hinged about a shaft 9 whose ends are held in the said sole 50, and the rear of sole plate 50 comprises a recess 13 whose profile is designed to work in conjunction with spherical end 25 of the cylindrical portion 19, as described earlier.

The fifth and sixth embodiments operate in the manner described earlier for the first embodiment.

The described ski binding may be used in all instances where one wishes to ensure the skier's safety in the event of falling forwards, backwards, sideways or in the event of a fall leading to a twist of the boot. In addition, the embodiment of FIGS. 6–8 is suitable whenever it is desired to use a single pair of skis for both downhill skiing and touring.

What is claimed is:

1. A ski binding, comprising;

an elongate soleplate extending from a first end to a second end;

an intermediate plate hingedly connected to the soleplate adjacent said first end about a transverse axis and having means defining an opening in said intermediate plate, said intermediate plate having a free end and an upper face;

a pin attachable perpendicular to a ski, said pin having an enlarged head which can pass through said opening in the intermediate plate;

means defining cooperating relatively inclined surfaces on the underside of said head of the pin and on said upper face of said intermediate plate in a part of said opening adjacent said free end; and spring operated means for releasably locking said second end of the soleplate to the ski subject to release of the soleplate by pivoting about said transverse axis and about said perpendicular pin, said spring operated means being attachable to the ski at a distance from said pin;

whereby in use said spring operated means urges said sole- plate and said intermediate plate in a direction towards said pin to inter- engage said cooperating surfaces and thereby releasably to lock said sole- plate to the ski, subject to movement of said first end of the sole- plate relative to the ski to free said soleplate by coaction of said cooperating surfaces against the action of said spring-operated means.

2. A ski binding according to claim 1, in which said soleplate is incorporated in a sole of a boot.

3. A ski binding according to claim 2, in which said soleplate comprises a generally flat plate attachable to a lower surface portion of said sole.

4. A ski binding according to claim 2, in which said boot sole includes means defining a recess for receiving therein said intermediate plate with said upper surface uppermost, and means for releasably holding the intermediate plate in said recess.

5. A ski binding according to claim 1, in which said first end of the soleplate is adapted to support the toe end of a boot and said second end is adapted to support the heel end of a boot, said spring-operated locking means comprising manually operable means for placing it in an inoperative position allowing free movement of said second end of the soleplate, the binding further comprising manually operable means for locking said soleplate and intermediate plate against pivoting about said pin while allowing pivoting of the soleplate about said transverse axis.

6. A ski binding according to claim 5, wherein said manually-operable locking means comprise a base plate adapted to be secured on the ski, a hook member slidably mounted on the base plate for movement along the axial direction of the ski, said hook member being adapted in one axial position to at least indirectly engage with and immobilize said intermediate plate, and screw means for holding said hook member in position.

7. A ski binding according to claim 1, in which said opening in the intermediate plate has an end portion which is V-shaped in plan view, and the means defining it comprises one of the means defining co-operative relatively inclined surfaces.

8. A ski binding according to claim 1, in which said soleplate is integral with the sole of a boot.

9. A ski binding according to claim 1 in which said spring-operated means includes manually operable means for unlocking the second end of the soleplate from the ski at will.

* * * * *